US007780471B2

(12) United States Patent
Hung et al.

(10) Patent No.: US 7,780,471 B2
(45) Date of Patent: Aug. 24, 2010

(54) CONNECTOR APPARATUS

(75) Inventors: Wen-Hsiang Hung, Taipei Hsien (TW); Lei Shen, Shenzhen (CN); Yong-Hua Xiao, Shenzhen (CN); Fu-Wei Dai, Shenzhen (CN); Zhen-Xing Wu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/344,265

(22) Filed: Dec. 25, 2008

(65) Prior Publication Data

US 2010/0136847 A1 Jun. 3, 2010

(30) Foreign Application Priority Data

Nov. 28, 2008 (CN) ..... 2008 1 0305850

(51) Int. Cl.
*H01R 13/60* (2006.01)

(52) U.S. Cl. ..... 439/540.1

(58) Field of Classification Search ..... 439/540.1, 439/541.5, 701, 717, 594, 607.23–607.26
See application file for complete search history.

(56) References Cited

U.S. PATENT DOCUMENTS

| | | | | |
|---|---|---|---|---|
| 4,469,393 | A * | 9/1984 | Chewning et al. | 439/717 |
| 5,122,077 | A * | 6/1992 | Maejima et al. | 439/398 |
| 5,984,727 | A * | 11/1999 | Wu et al. | 439/607.02 |
| 6,234,834 | B1 * | 5/2001 | Tsai et al. | 439/541.5 |
| 6,471,546 | B1 * | 10/2002 | Zhu et al. | 439/607.4 |
| 6,688,913 | B2 * | 2/2004 | Li | 439/541.5 |
| 7,108,561 | B2 * | 9/2006 | Khemakhem et al. | 439/668 |

* cited by examiner

*Primary Examiner*—T C Patel
*Assistant Examiner*—Phuong Nguyen
(74) *Attorney, Agent, or Firm*—Zhigang Ma

(57) ABSTRACT

A connector apparatus includes a main body. The main body includes a first module, and a second module. The first and second modules are detachably assembled together. At least one connector is fixed in each of the first and second modules.

6 Claims, 6 Drawing Sheets

CONNECTOR APPARATUS

BACKGROUND

1. Technical Field

The disclosure relates to connector apparatuses and, more particularly, to a connector apparatus for an electronic device.

2. Description of Related Art

Traditional input/output (I/O) connectors are fixed to an electronic device via being welded to a printed circuit board (PCB) of the electronic device. However, it is inconvenient to examine and repair the connectors since the PCB would be implicated.

DETAILED DESCRIPTION

Figure 1:
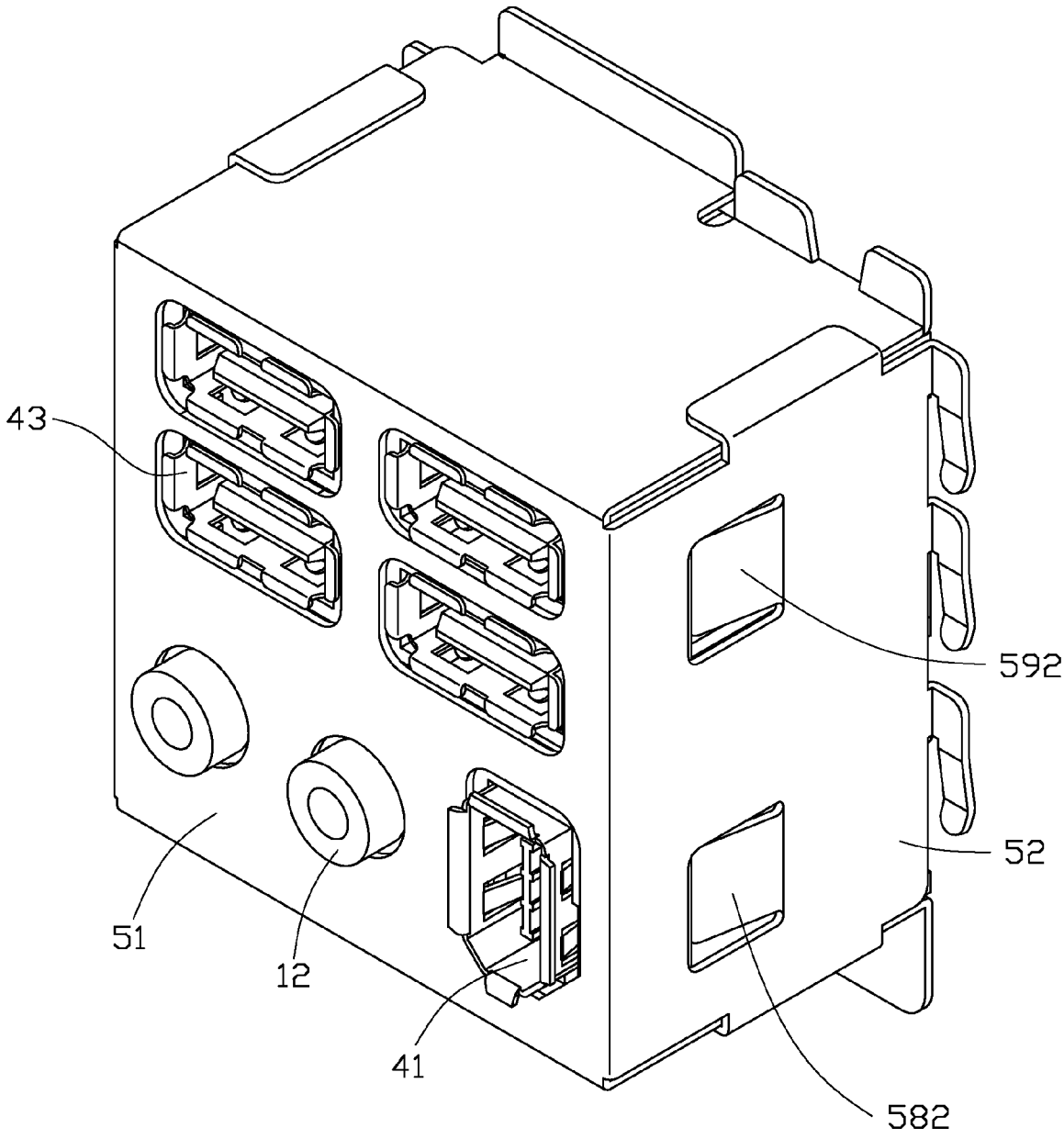
FIG. 1 is an isometric view of a first exemplary embodiment of a connector apparatus.
Figure 2:
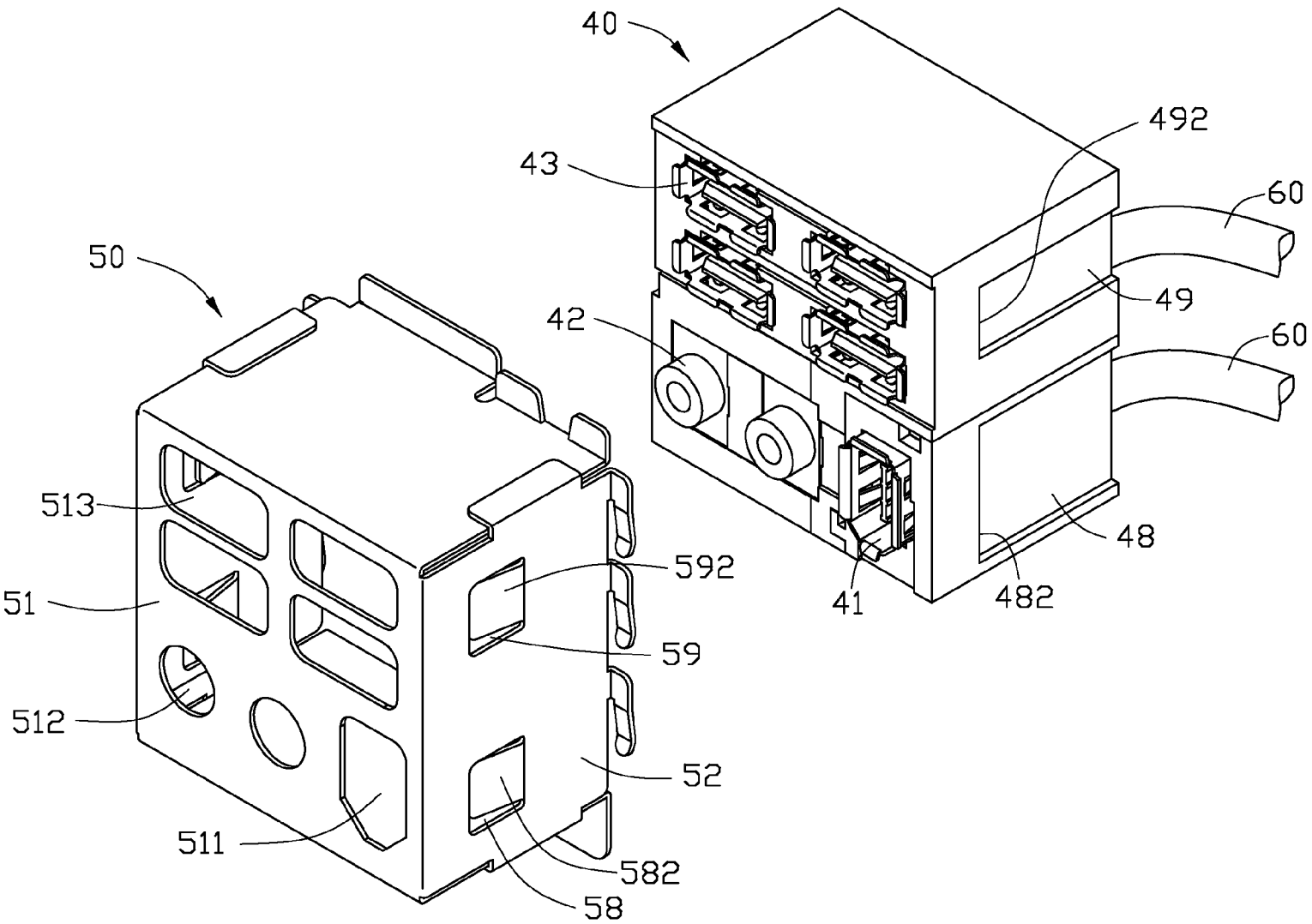
FIG. 2 is an exploded, isometric view of the connector apparatus of FIG. 1, the connector apparatus including a main body.

Referring to FIGS. 1 and 2, a first exemplary embodiment of a connector apparatus includes a main body 40 and a housing 50. In one embodiment, the connector apparatus is used to connect with I/O devices.

Figure 3:
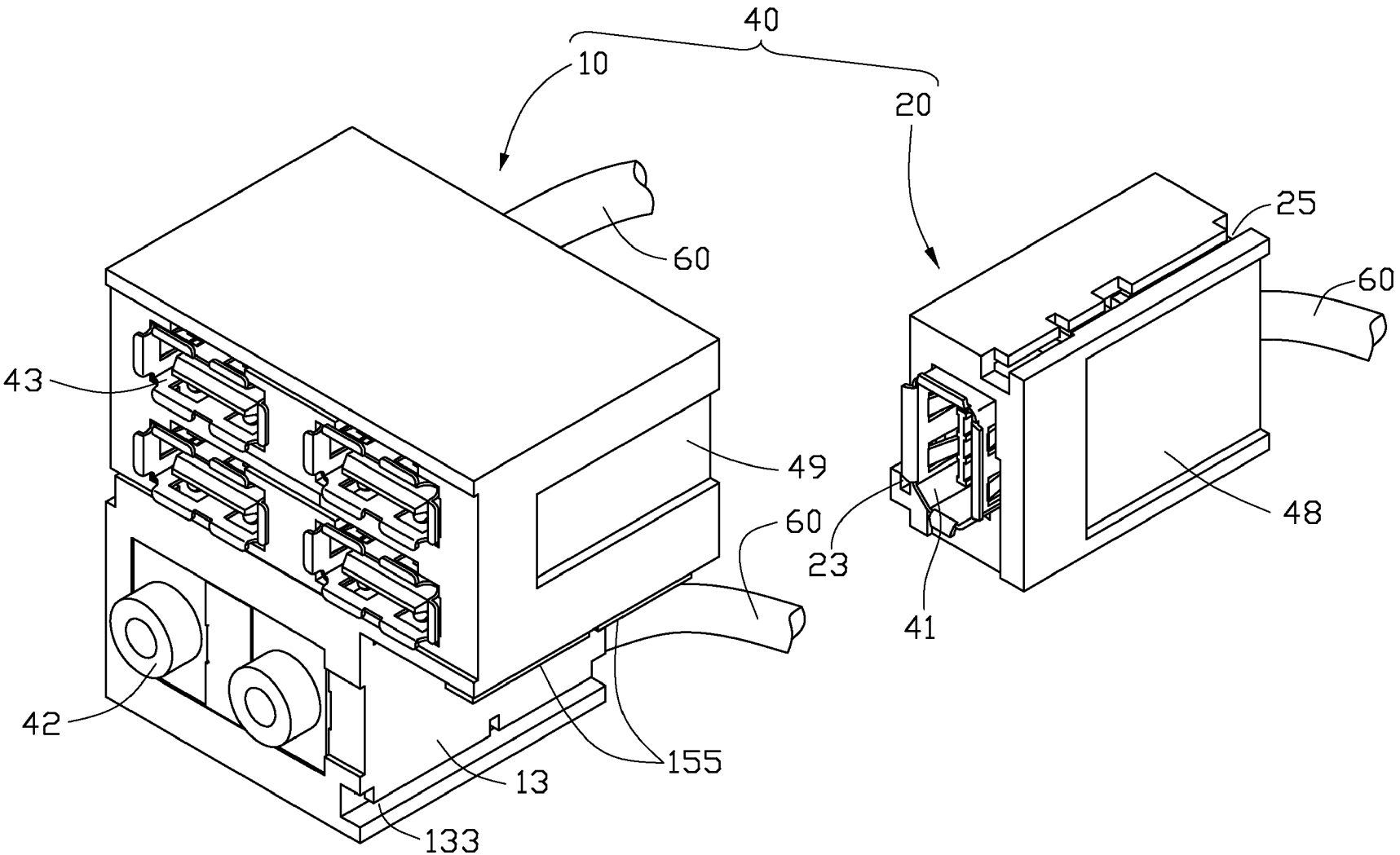
FIG. 3 is an exploded, isometric view of the main body in FIG. 2.

Referring to FIG. 3, in the instant embodiment, the main body 40 includes an L-shaped first module 10 including a horizontal first part and a vertical second part, and a second module 20. The second module 20 is mountable in the first module 10 by connecting to the first and second parts of the first module 10, to form the generally cuboid-shaped main body 40.

The main body 40 defines a plurality of receiving grooves (not labeled), for receiving a plurality of connectors. In the instant embodiment, the plurality of connectors includes a first connector 41 mounted to a corresponding receiving groove defined in the front of the second module 20, and two second connectors 42 and four third connectors 43 mounted to the corresponding receiving grooves defined in the front of the first module 10. The connectors 41, 42 and 43 are secured in the corresponding receiving grooves via supersonic welding. A plurality of cables 60 extends from the back of the first and second modules 10 and 20 of the main body 40, for electrically connecting the connectors 41, 42, and 43 to a PCB (not shown) of an electronic device (not shown). A plurality of first installing grooves 49 is defined in two opposite outer sides connected between the front and the back of the first module 10. A second installing groove 48 is defined in a first side connected between the front and the back of the second module 20. A sidewall bounding an edge of the second installing groove 48 adjacent to the front of the second module 20 forms a blocking portion 482. A sidewall bounding an edge of the first installing groove 49 adjacent to the first surface of the first module 10 forms a blocking portion 492. In one embodiment, the main body 40, except the connectors 41, 42 and 43 is generally made of plastic.

Figure 4:
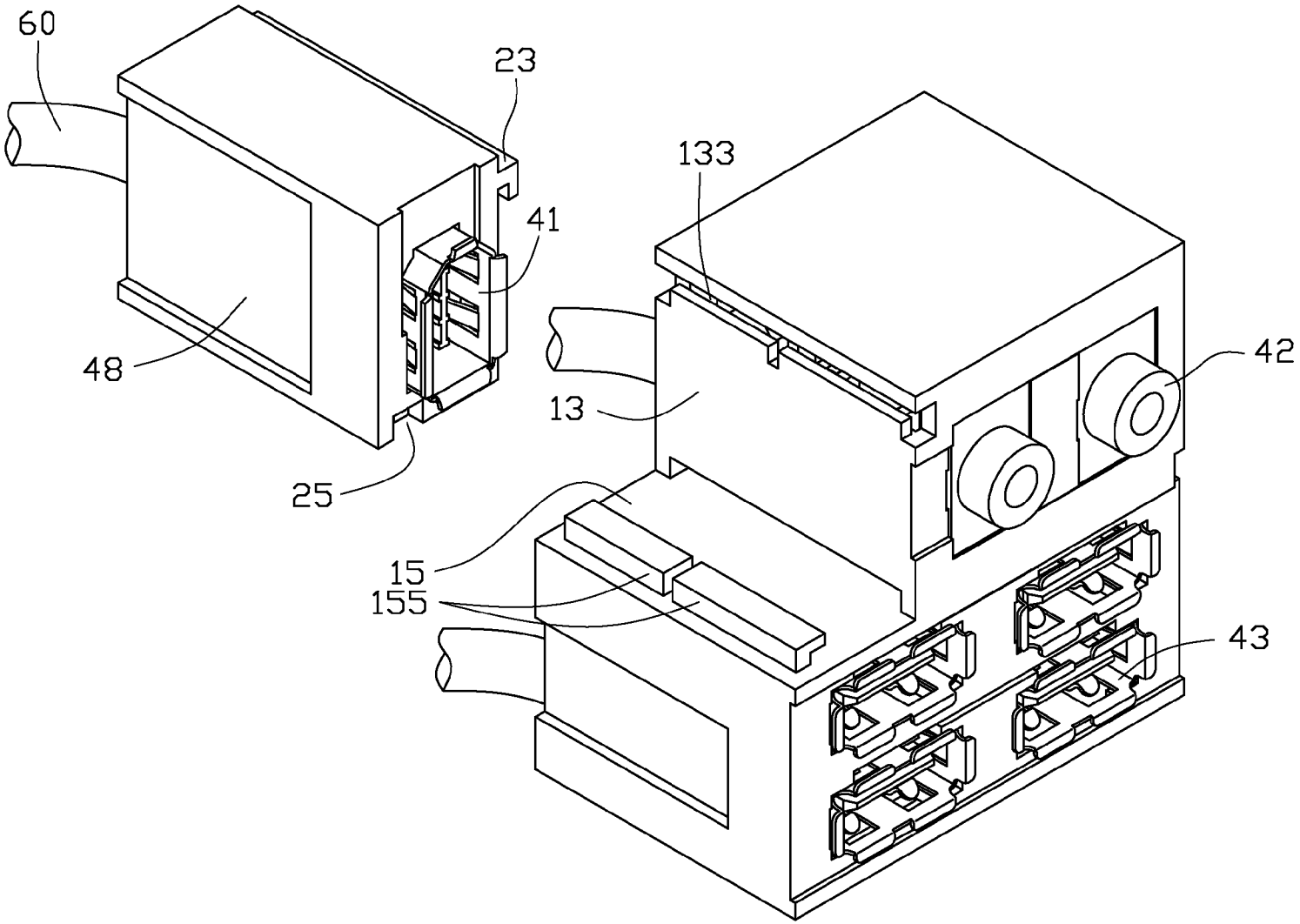
FIG. 4 is an inverted view of FIG. 3.

Referring to FIGS. 3 and 4, a depressed portion (not labeled) is defined in the side of the vertical part of the first module 10, for receiving the second module 20. The depressed portion includes a first fitting surface 13 parallel to the sides of the first module 10 defining the installing grooves 49 and a second fitting surface 15 perpendicular with the first fitting surface 13 and the front of the first module 10. An L-shaped sliding rail 23 extends from a second side of the second module 20 opposite to the first side of the second module 20. An L-shaped sliding groove 133 is defined in a lower portion of the first fitting surface 13 of the first module 10 corresponding to the sliding rail 23. An L-shaped sliding groove 25 is defined in the top of the second module 20. An L-shaped sliding rail 155 extends from the second fitting surface 15 of the first module 10 corresponding to the sliding groove 25. The second module 20 can be slid in the depressed portion of the first module 10 via engagement between each of the sliding rails 23 and 155 and a corresponding one of the sliding grooves 133 and 25, thereby slidably assembling the first module 10 and the second module 20 together.

Referring again to FIG. 2, the housing 50 is used for receiving and protecting the main body 40. In one embodiment, the housing 50 is made of conductive material, such as metal. The shape of a receiving space of the housing 50 substantially corresponds to the shape of the main body 40. The housing 50 includes a rectangular front plate 51 and four side plates 52 perpendicularly connected to four sides of the front plate 51. The receiving space for receiving the main body 40 is bounded by the front plate 51 and the four side plates 52. A plurality of square holes 59 is defined in two opposite plates 52 corresponding to the installing grooves 49. A square hole 58 is defined in one of the two opposite plates 52 corresponding to the installing groove 48. An elastic blocking piece 592 extends from each hole 49 into the housing 50 from a wall away from the front plate 51 bounding each hole 59. An elastic blocking piece 582 extends from the hole 58 into the housing 50 from a wall away from the front plate 51 bounding the hole 58. A plurality of through holes 511, 512 and 513 matching with ports of the connectors 41, 42 and 43 is defined in the front plate 51.

Referring again to FIG. 1, in assembly, the first module 10 and the second module 20 are assembled together to form the main body 40. The main body 40 is inserted into the housing 50. When the blocking pieces 582 and 592 contact the main body 40, the main body 40 drives the blocking pieces 582 and 592 to elastically deform. When free ends of the blocking pieces 582 and 592 align over the corresponding installing grooves 48 and 49, the blocking pieces 582 and 592 restore, and the free ends of the blocking pieces 582 and 592 fall into the corresponding installing grooves 48 and 49 and abut against the corresponding blocking portions 482 and 492. Therefore, the main body 40 is securely received in the housing 50, with the ports of the connectors 41, 42 and 43 exposing via the through holes 511, 512 and 513, so as to be used.

In disassembly, a screwdriver may be used to pry up the blocking pieces 582 and 592, thereby disengaging the free ends of the blocking pieces 582 and 592 from the corresponding blocking portions 482 and 492. Thus, the main body 40 can be taken out of the housing 50. If only the second module 20 is needed to be disassembled, the corresponding blocking piece 582 is pried up, and then the second module 20 can be slid out of the housing 50.

In one embodiment, the first connector 41 of the second module 20 is a IEEE 1394 connector, which is infrequently used. Some electronic device does not need a IEEE 1394 connector, but other kinds of connectors may be needed. Thus, another second module with other kinds of connectors can be provided to replace the second module 20. In other words, the connector apparatus of the disclosure is partly replaceable. Thus, the cost is reduced for both factories and the consumers.

In other embodiments, the main body 40 may be some other shape, such as cylindrical. The number, the types, or the arrangement of the connectors 41, 42 and 43 may be adjusted, too.

Figure 5:
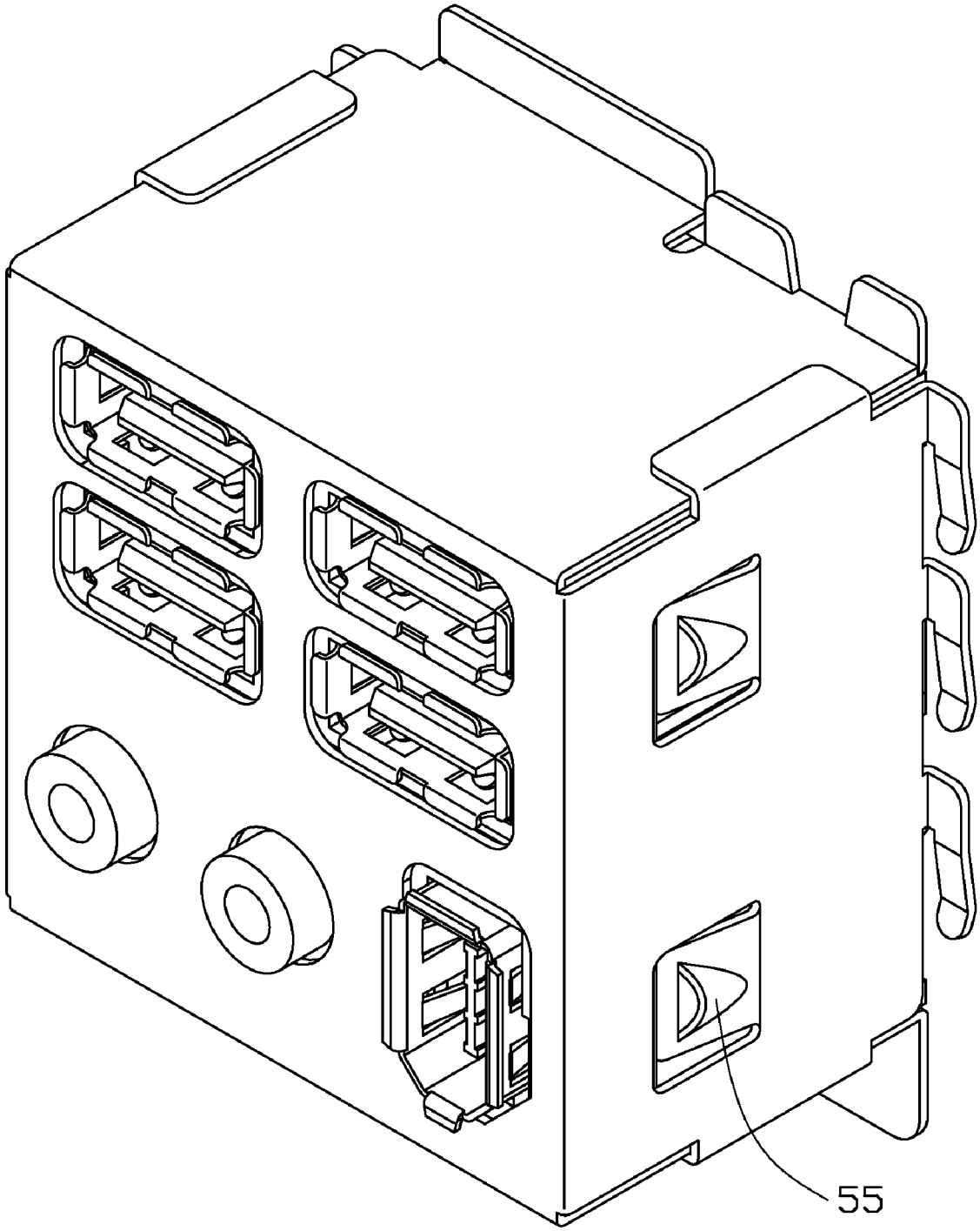
FIG. 5 is an isometric view of a second exemplary embodiment of a connector apparatus.

Referring to FIG. 5, in a second exemplary embodiment, an operating portion 55 extends outward from each blocking piece for facilitating raising the corresponding blocking piece with a finger.

Figure 6:
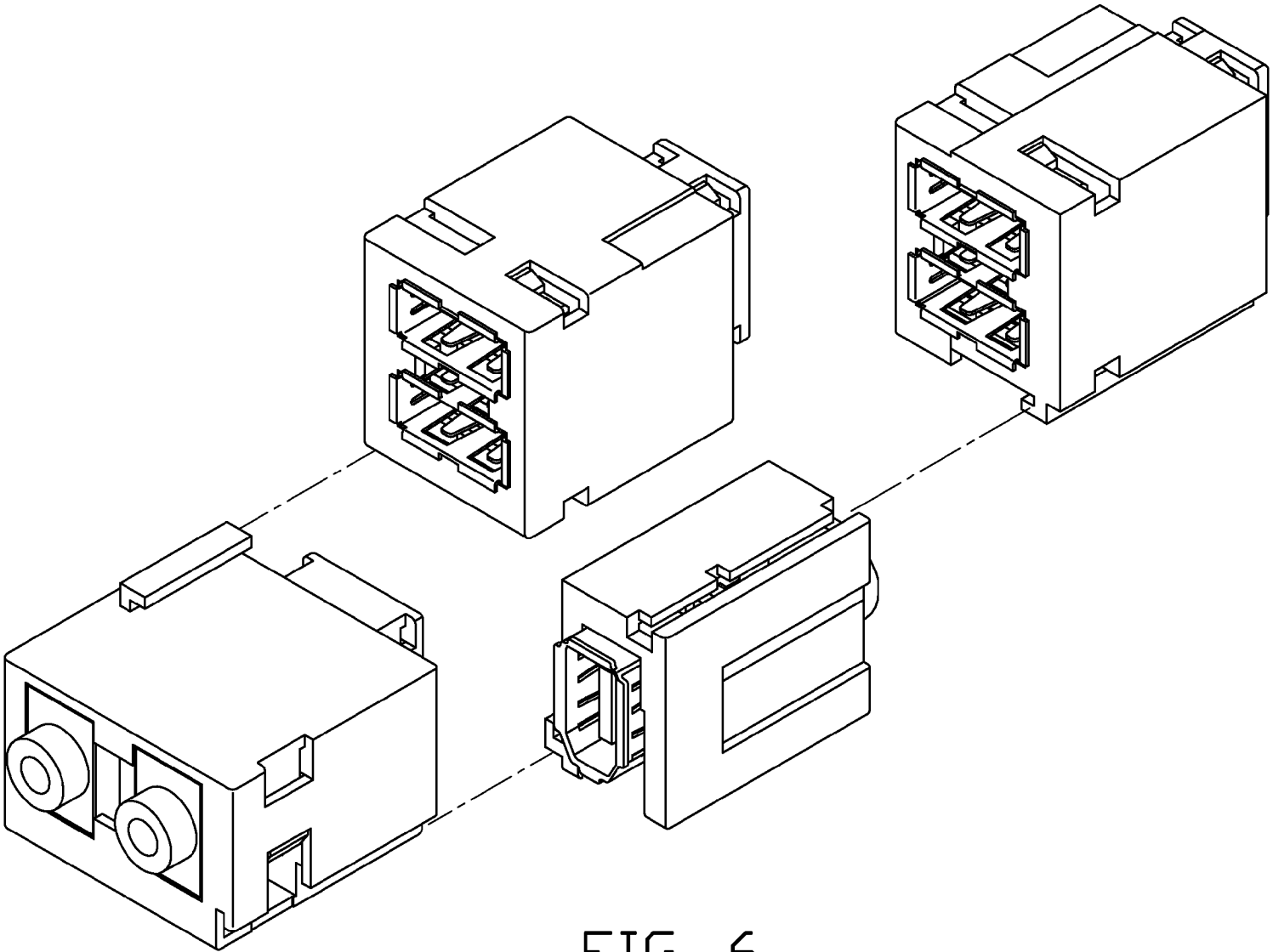
FIG. 6 is an exploded, isometric view of a third exemplary embodiment of a connector apparatus.

Referring to FIG. 6, in a third exemplary embodiment, the main body is divided into four modules, each including at least one connector. For each two modules, engagement between an L-shaped sliding rail and an L-shaped sliding groove is used. In this way, the four modules can be assembled together as a whole.

It is to be understood, however, that even though numerous characteristics and advantages of the disclosure have been set forth in the foregoing description, together with details of the structure and function of the invention, the disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. A connector apparatus comprising:

a main body comprising a first module and a second module, the first and second modules are detachably assembled together, at least one connector is fixed in each of the first and second modules;

a housing, wherein the main body is detachably mounted in the housing;

wherein the housing comprises a front plate, the main body comprises a front surface abutting against the front plate when the main body is mounted in the housing, a plurality of installing grooves is defined in the main body, a wall adjacent to the front surface of the main body for bounding an edge of each of the installing grooves forms a blocking portion, a plurality of blocking pieces extends inward from the housing; when the main body is mounted in the housing, free ends of the blocking pieces are capable of abutting against the blocking portions, respectively, to fix the main body in the housing;

wherein an operating portion extends outward from each of the blocking pieces, for the blocking piece being operated;

wherein the first module comprises a depressed portion, the second module is detachably mounted in the depressed portion;

wherein the first module is L-shaped with a horizontal part and a vertical part, the second module is located contacting the horizontal part and the vertical part to form the main body which is generally cuboid-shaped, ports of the connectors are exposed from a front surface of the main body.

2. The connector apparatus of claim 1, wherein at least two through holes are defined in the housing, ports of the connectors are capable of exposing via the through holes.

3. The connector apparatus of claim 1, wherein the installing grooves are defined in outer surfaces of the first and second modules.

4. The connector apparatus of claim 1, wherein a first sliding rail extends from the first module, a first sliding groove is defined in the second module, the first sliding rail is capable of engaging with the first sliding groove to slidably assemble the first and the second modules together.

5. The connector apparatus of claim 4, wherein a second sliding groove is defined in the first module, a second sliding rail slidable mounted in the second sliding groove extends from the second module.

6. The connector apparatus of claim 5, wherein the first and second sliding rails, and the first and second sliding grooves are all L-shaped.

* * * * *